US007131787B2

(12) United States Patent
McGinn

(10) Patent No.: US 7,131,787 B2
(45) Date of Patent: Nov. 7, 2006

(54) DRAIN INLET COVER

(75) Inventor: John H. McGinn, Sacramento, CA (US)

(73) Assignee: Ertec Environmental Systems LLC, Sacramento, CA (US)

( * ) Notice: Subject to any disclaimer, the term of this patent is extended or adjusted under 35 U.S.C. 154(b) by 0 days.

(21) Appl. No.: 11/127,614

(22) Filed: May 11, 2005

(65) Prior Publication Data

US 2006/0002773 A1 Jan. 5, 2006

Related U.S. Application Data

(63) Continuation-in-part of application No. 10/843,010, filed on May 11, 2004, now Pat. No. 7,008,144, and a continuation-in-part of application No. pct/us04/042092, filed on Dec. 16, 2004.

(60) Provisional application No. 60/655,287, filed on Feb. 22, 2005, provisional application No. 60/648,693, filed on Jan. 31, 2005, provisional application No. 60/569,979, filed on May 11, 2004.

(51) Int. Cl.
*E02B 3/06* (2006.01)
*E02D 17/20* (2006.01)

(52) U.S. Cl. ..... 405/36; 405/302.7; 405/302.6; 404/4

(58) Field of Classification Search ..... 405/36, 405/302.7, 302.6; 404/2–5
See application file for complete search history.

(56) References Cited

U.S. PATENT DOCUMENTS 3,112,262 A 11/1963 Parkinson ..... 210/130
3,455,112 A 7/1969 Twele ..... 61/3
4,854,773 A 8/1989 Nicoll ..... 405/15
5,108,224 A 4/1992 Cabaniss et al. ..... 405/52
5,257,878 A 11/1993 Peterson ..... 405/15
5,338,131 A 8/1994 Bestmann ..... 405/24
5,575,584 A 11/1996 Alsop ..... 405/24
5,632,888 A 5/1997 Chinn et al. ..... 210/163
5,733,825 A 3/1998 Martin et al. ..... 428/372
5,954,451 A 9/1999 Presby ..... 405/49
5,954,952 A * 9/1999 Strawser, Sr. ..... 210/164
6,017,166 A * 1/2000 Mossburg, Jr. ..... 404/5
6,214,216 B1 * 4/2001 Isaacson ..... 404/4
6,277,473 B1 8/2001 McGinn ..... 428/188
6,332,737 B1 12/2001 Mattson ..... 405/63
6,422,787 B1 7/2002 Mikell ..... 405/15
6,497,532 B1 12/2002 McGinn ..... 405/27
6,505,996 B1 1/2003 Ianniello et al. ..... 405/36
6,547,493 B1 4/2003 Spangler et al. ..... 405/302.6
6,551,505 B1 4/2003 Chinn et al. ..... 210/164
6,641,335 B1 11/2003 Allard ..... 405/302.6
6,709,579 B1 * 3/2004 Singleton et al. ..... 404/4
6,733,209 B1 5/2004 Allard ..... 405/302.6
6,811,708 B1 11/2004 Shaw et al. ..... 210/747

(Continued)

FOREIGN PATENT DOCUMENTS

GB 2171131 8/1986

*Primary Examiner*—Frederick L. Lagman
(74) *Attorney, Agent, or Firm*—T. H. P. Richardson

(57) ABSTRACT

A drain inlet cover for a drain in a road which is bordered by a sidewalk and separated from the sidewalk by a curb, with access to the drain through an opening in the curb. The cover includes a horizontal section which lies on the road and a vertical section which covers the opening in the curb. Each section includes a filter member which lies between two apertured polymeric members.

20 Claims, 2 Drawing Sheets

U.S. PATENT DOCUMENTS 6,848,866 B1 2/2005 McGinn ..... 45/302.6
6,974,540 B1 * 12/2005 Fleischmann ..... 404/4
2002/0020658 A1 * 2/2002 Isaacson ..... 404/4
2003/0143026 A1 7/2003 Sentha ..... 405/15

* cited by examiner

DRAIN INLET COVER

CROSS-REFERENCE TO RELATED APPLICATIONS

This application is related to, and claims priority from, (1) my Provisional Application No. 60/569,979, filed May 11, 2004, (2) my application Ser. No. 10/843,010 filed May 11, 2004, (3) International Application No. PCT/US 2004/042092, filed Dec. 16, 2004, (4) my Provisional Application No. 60/648,963, filed Jan. 31, 2005, and (5) my Provisional Application No. 60/655,287, filed Feb. 22, 2005.

This application is a continuation-in-part of my application Ser. No. 10/843,010 filed May 11, 2004 now U.S. Pat. No. 7,008,144 and a continuation-in-part of International Application No. PCT/US 2004/042092. filed Dec. 16, 2004 International Application No. POT/US 2004/042092 is a continuation-in-part of application Ser. No. 10/843,010. This application is also related to my application Ser. No. 10/742,076, filed Dec. 19, 2003, now U.S. Pat. No. 6,848,866. The entire disclosure of each of those applications and patent is incorporated herein by reference for all purposes.

BACKGROUND OF THE INVENTION

This invention relates to drain inlet covers for roadside drains.

The term "roadside drain" is used herein to denote a drain to which there is access through an opening in the curb and which has a rear portion which is unobstructed at the road level but is covered by the sidewalk. The drain may also have an exposed front portion set in the roadway and covered by a grate. It is known to reduce the amount of sediment passing into a drain by placing a drain basket (or silt collection bag) in the drain. However, such drain baskets are difficult to maintain in operating condition, and are subject to breakage. The term "sediment" is used herein to denote solid particulate material, e.g. soil, sand or pebbles, which can become suspended, or which is suspended, in a flowing stream of liquid, and which will settle out of the liquid when the liquid ceases to flow. It is often desirable, and sometimes legally required, to collect sediment from liquid in which it is suspended. For example, in some cases, the law requires removal of sediment from liquid flowing out of a construction site.

SUMMARY OF THE INVENTION

This invention provides an improved drain inlet cover which can be placed over a roadside drain to collect sediment from sediment-bearing liquid before the liquid passes into the drain.

In a first aspect, this invention provides a drain inlet cover suitable for installation over a roadside drain as defined above. The novel drain inlet cover comprises 1 ) a horizontal laminar section which has front, rear and side edges, and 2) a vertical section which has a lower edge secured to the rear edge of the horizontal section;

the horizontal section comprising (a) an upper laminar member which has a plurality of relatively large apertures therethrough, (b) a lower laminar member which has a plurality of relatively large apertures therethrough, and (c) a horizontal laminar filter member which (i) is sandwiched between the upper and lower members, and (ii) has a plurality of relatively small (i.e. smaller than the apertures in the upper and lower members) filter apertures therethrough; and the vertical section comprising (a) a front member which has a plurality of relatively large apertures therethrough, (b) a rear member which has a plurality of relatively large apertures therethrough, and (c) a vertical filter member which (i) lies between the front and rear members, and (ii) has a plurality of relatively small filter apertures therethrough (i.e. apertures smaller than the apertures in the front and rear members).

The terms "horizontal" and "vertical" are used herein to include practical deviations from precisely horizontal and precisely vertical. Thus, in this specification, all roadways are "horizontal" and all curbs are "vertical", even though they frequently deviate from precisely horizontal or precisely vertical by up to a number of degrees, e.g. up to 10 or 15° or more. The term "laminar member" is used herein to denote a member having two long dimensions and one short dimension. The laminar members in the horizontal section are generally flat. The front, rear and vertical filter members are often laminar, and may be flat or curved, as further explained below.

In a second aspect, this invention provides a method of reducing the amount of sediment which passes through a drain in a road, the drain being bordered by a sidewalk and separated from the sidewalk by a vertical curb, the curb having an opening which provides access to the drain, and the drain having a rear portion which is unobstructed at the road level but is covered by the sidewalk, the method comprising placing a drain inlet cover as defined in the first aspect of the invention over the drain, the horizontal section of the drain inlet cover being placed on the road and the vertical section being placed so that it covers at least a lower portion of the opening in the curb and overlaps side edges of the opening in the curb. When the drain includes a grate which is set in the road and which has front, rear and side edges, the rear edge being adjacent to the opening in the curb, the front and side edges of the horizontal portion of the drain inlet cover overlap the front and side edges of the grate, and the horizontal filter member extends over substantially all of the grate.

In this way, some or all the sediment-bearing liquid directed towards the drain passes through the horizontal and/or vertical filter member before entering the drain. If the vertical filter member does not completely cover the opening in the curb, and the sediment-bearing liquid has a level higher than the top edge of the vertical filter member, the upper portion of the sediment-bearing liquid enters the drain without passing through either of the filter members. It is possible to place a berm around part or all of the sides of the horizontal section so that some sediment can settle out of the sediment-bearing liquid before it reaches the drain cover. The berm can be attached to the drain inlet cover before or after the cover is put in place, and/or positioned on the road after the cover has been placed over the drain.

In a third preferred aspect, the invention provides a method of making a drain inlet cover, preferably a drain inlet cover according to the first aspect of the invention, the method comprising (A) providing a precursor comprising (a) a first laminar member which is composed of a polymeric material and has a plurality of relatively large apertures therethrough, (b) a second laminar member which is composed of a polymeric material and has a plurality of relatively large apertures therethrough, and (c) a laminar filter member which (i) is composed of the polymeric material, (ii) is sandwiched between the first and second members, and (iii) has a plurality of relatively small filter apertures therethrough;

(B) configuring the precursor into a configuration providing the horizontal and vertical sections; and (C) stabilizing the precursor in the configuration.

In a fourth preferred aspect, this invention provides a precursor suitable for use in the method of the third aspect of the invention, the precursor comprising (a) a first laminar substantially rectangular member which is composed of a polymeric material and has a plurality of relatively large apertures therethrough, (b) a second laminar substantially rectangular member which is composed of a polymeric material and has a plurality of relatively large apertures therethrough, and (c) a laminar substantially rectangular filter member which (i) is composed of a polymeric material, (ii) is sandwiched between the first and second members, and (iii) has a plurality of relatively small filter apertures therethrough.

In a preferred embodiment of the fourth aspect of the invention, the precursor comprises (a) a first laminar substantially rectangular member which is composed of a polymeric material and has a plurality of relatively large apertures therethrough, (b) a second laminar substantially rectangular member which is composed of a polymeric material and has a plurality of relatively large apertures therethrough, and which overlaps 80 to 100% of the first layer; and (c) a laminar substantially rectangular filter member which (i) is composed of a polymeric material, (ii) is sandwiched between, and does not extend beyond the first and second members, and which overlaps 80 to 100% of the area of the second member, and (iii) has a plurality of relatively small filter apertures therethrough; and a part of the first member, or a part of the second member, or parts of both the first member and the second member, extending beyond the filter member to provide a rectangular section which is free of the filter member. The filter member can comprise a first component which becomes, in the drain inlet cover, the horizontal filter member, and a second component which becomes, in the vertical member, the vertical filter member.

BRIEF DESCRIPTION OF THE DRAWINGS

The invention is illustrated in the accompanying drawings, which are diagrammatic sketches and are not to scale, and in which.

DETAILED DESCRIPTION OF THE INVENTION

Figure 1:
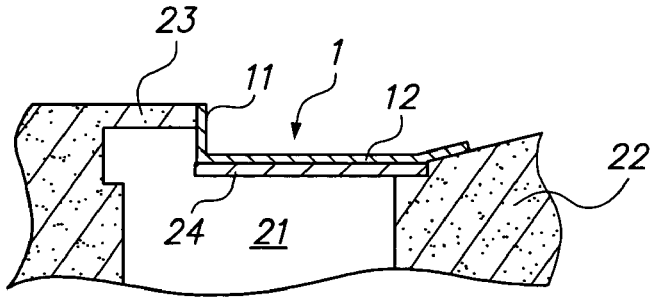
FIG. 1 is a cross-section.

In the Summary of the Invention above, the Detailed Description of the Invention, the Examples, and the Claims below, and the accompanying drawings, reference is made to particular features of the invention, including for example components, ingredients, devices, apparatus, systems and steps. It is to be understood that the disclosure of the invention in this specification includes all possible combinations of such particular features. For example, where a particular feature is disclosed in the context of a particular embodiment, a particular Figure, or a particular claim, that feature can also be used, to the extent possible, in the context of other particular embodiments, Figures and claims, and in the invention generally. The invention claimed herein includes embodiments not specifically described herein and can for example make use of features which are not specifically described herein but which provide functions which are the same, equivalent or similar to, features specifically disclosed herein.

The term "comprises" and grammatical equivalents thereof are used herein to mean that other features are optionally present. For example, a composition "comprising" (or "which comprises") ingredients A, B and C can contain only ingredients A, B and C, or can contain not only ingredients A, B and C but also one or more other ingredients. The term "consisting essentially of" and grammatical equivalents thereof are used herein to mean that other features may be present which do not materially alter the claimed invention. Where reference is made herein to a method comprising two or more defined steps, then, unless the context requires otherwise, the defined steps can be carried out in any order or simultaneously, and the method can include one or more other steps which are carried out before any of the defined steps, between two of the defined steps, or after all the defined steps. The term "at least" followed by a number is used herein to denote the start of a range beginning with that number (which may be a range having an upper limit or no upper limit, depending on the variable being defined). For example, "at least 40" means 40 or more than 40. When, in this specification, a range is given as "(a first number) to (a second number)" or "(a first number)-(a second number)", this means a range whose lower limit is the first number and whose upper limit is the second number. For example, "0.1 to 1.0 inch" means a range whose lower limit is 0.1 inch, and whose upper limit is 1.0 inch. The numbers given herein should be construed with the latitude appropriate to their context and expression. The terms "plural" and "plurality" are used herein to mean two or more.

When reference is made herein to "a", "an", "one" or "the" feature, it is to be understood that, unless the context requires otherwise, there can be one or more than one such feature. For example, when reference is made herein to a feature selected from a list of features, it is to be understood that, unless the context requires otherwise, the feature can be a single one of the listed features or two or more of the listed features.

When reference is made herein to a first feature and/or a second feature, it is to be understood that unless the context requires otherwise, such terminology is used herein for convenience in identifying such features, and means that either or both features can be present, and that when both features are present, they can be the same or different.

Where reference is made herein to two or more components (or parts or portions etc.), it is to be understood that the components can be, unless the context requires otherwise, separate from each other or integral parts of a single structure or a single component acting as the two or more specified components.

Upper, Lower, Front and Rear Members

The upper member of the horizontal section and the front member of the vertical section have relatively large apertures therethrough, such that at least a large proportion of the sediment can pass through them. The size of the apertures and of the solid members defining the apertures can be such that the speed of liquid directed at the upper and front members is substantially reduced. The upper and front members are preferably the first part of the drain inlet cover which opposes the flow of the sediment-bearing liquid. The lower member of the horizontal section and the rear member of the vertical section also have relatively large apertures therethrough. Often all the apertures in each member have the same size and/or shape, though this is not necessary. The apertures can be of any shape, for example polygonal, including triangular and parallelogrammatic (including rectangular, e.g. square), round or oval. In some embodiments, each of the apertures is in the shape of a parallelogram in which the acute angles are from 60 to 82°. The area of each of the apertures (or the median area of the apertures, if they are of different sizes) can for example be 0.01 to 1.0, preferably 0.02 to 0.25, particularly 0.03 to 0.16, e.g. 0.04 to 0.1, $in^2$, and/or each of the apertures can have a minimum dimension in the range of 0.1 to 1.0, preferably 0.15 to 0.5, particularly 0.15 to 0.4, e.g. 0.2 to 0.3, inch, i.e. the aperture will permit passage of spherical particles having a diameter less than the minimum dimension and prevent passage of spherical particles having a diameter greater than the minimum dimension. Such apertures provide little or no resistance to many of the sedimentary particles generally encountered in practice, but prevent the passage of larger objects entrained by the liquid, for example sticks, cans and plastic bottles.

The greater the ratio of solid surface area to the total area, the more the upper and front members will slow down the stream of sediment-bearing liquid. This enhances removal of sediment from the liquid by the filter members. However, if the stream is slowed too much by the drain inlet cover, or the volume of liquid is too great, some of the sediment-bearing liquid will flow over the top of the rear filter member without any sediment being removed therefrom. In some embodiments of the invention, the solid surface area of the upper and front members is 10 to 80%, for example 25 to 65%, of the total area, both areas being viewed at right angles to the plane of the member.

The upper, lower, front and rear members can be composed of a multiplicity of strands, e.g. polymeric strands, connected together at junction points, thus providing a solid network against and through which the liquid flows. The thickness of the polymeric strands, viewed at right angles to the plane of the member, can for example be 0.08 to 0.3 inch (2 to 7.5 mm), e.g. 0.1 to 0.2 inch (2.5 to 5 mm). Thus, suitable materials include the heavier grades of netting obtained by melt-extruding an organic polymer. Methods for producing such netting are well-known, and may for example make use of two rapidly rotating, opposed extrusion heads, each set to extrude polymeric strands at the same angle to the principal axis of the resulting product, i.e. the machine direction. The resulting netting comprises generally parallelogram-shaped apertures defined by (i) a multiplicity of first strands which are parallel to each other and (ii) a multiplicity of second strands which are parallel to each other, the first strands and second strands being at the same angle to the principal axis of the netting.

The upper, lower, front and rear members are preferably composed of a polymeric composition (i.e. a composition containing a polymer and conventional additives such as fillers) which can be melt shaped, particularly a composition which does not absorb substantial amounts of water in use and/or which can be recycled and/or which is resistant to ultraviolet light, e.g. through the inclusion of 2–3% by weight of carbon black. Suitable polymers for the composition include polyolefins, particularly high density polyethylene and polypropylene. The polymer can be cross-linked, for example by exposure to electron beam radiation. It is preferable to avoid the use of polymeric compositions which can decompose, or release materials harmful to the environment, including wildlife, for example polymers containing leachable plasticizers. Other materials which can be used are suitably apertured metal sheets, and interconnected metal wires, optionally coated with synthetic polymers.

It is often convenient, but is not necessary, to use the same apertured material for the upper, lower, front and rear members. For example, the front and upper members can be provided by a single piece of first apertured material, and the rear and lower members can be provided by a single piece of the same or a different apertured material.

If it is desirable to recycle the drain inlet cover, the upper, lower, front and rear members are preferably composed of materials which can be recycled in the same batch. High density polyethylene offers a good balance between strength, flexibility, toughness, stability, cost, availability, recyclability, and environmental acceptability. Other satisfactory polymers include polypropylene and low density polyethylene.

The upper, lower, front and rear members are preferably composed of materials, and have dimensions, such that the sediment control roll has adequate strength, toughness and flexibility, without the need for additional support members. However, the drain inlet cover can include one or more support members, as described below.

In some embodiments of the invention, the front and rear members are laminar members, preferably flat laminar members, having the vertical filter member sandwiched between them and in contact with each of them. In other embodiments, the vertical filter member contacts the rear member only, or the front member only, or contacts neither the front member nor the rear member and is supported by a separate support. In such other embodiments, the front and rear members define a hollow chamber between them and are often laminar members which are flat or curved. For example, the front and rear members and the vertical filter member can together provide a sediment control roll as defined in one or more of U.S. Pat. No. 6,848,866, application Ser. No. 10/843, 010, Application No. PCT/US 2004/

042092, Application No. 60/648,963 and Application No. 60/650 5287, incorporated by reference herein (the front, rear and vertical filter members then being the "threshold, outflow and outflow filter members" and the horizontal section being the "location member", as those terms are used in those applications and patent).

Filter Members

The horizontal and vertical filter members are contacted by the sediment-bearing liquid after it has passed through the upper or front member. The filters may be composed of the same or different filter materials.

When the drain includes a grate set in the road, the horizontal filter extends over the part of the horizontal section which covers the grate, and optionally extends over part or all of the marginal front and side portions of the horizontal section which lie on the road adjacent to the grate.

To ensure that the drain continues to function if there is an unusually high volume of sediment-bearing liquid or if the filters become clogged, it is preferable (i) that the top edge of the vertical section should be below the top edge of the opening in the curb, and/or (ii) that a top portion of the vertical section should be free of filter material, and optionally also free of one or both of the apertured front and rear members. Thus, the vertical filter can extend over only a lower portion of the vertical section, the lower portion extending from the bottom of the vertical section to an upper level which is at least 60%, e.g. 60 to 80%, of the height of the vertical section.

If the characteristics of the sediment-containing liquid can be predicted, then the characteristics, including but not limited to the mesh size, of the filters can be selected accordingly. In general, the filter layer(s) have a mesh size (measured by ASTM D4751 and/or ASTM E-11) of at least 200 micron, preferably 200 to 600, e.g. 200 to 500, micron, e.g. about 425 or about 300 micron. Such filters are commercially available. The filter material can for example be sheet material having a substantially uniform thickness of less than 0.5 inch, or less than 0.25 inch, for example 0.01–0.06 inch, preferably 0.01–0.04 inch, e.g. 0.013–0.028 inch.

In tests in which clean water is passed through the filter material, on its own, the filter material, depending on its mesh size, is generally capable of passing at least 20, e.g. at least 40, gallons of water per square foot per minute, but not more than 800, e.g. 100 to 200, gallons of water per square foot per minute.

The filters are preferably composed of a synthetic polymer, particularly a polymer which does not absorb substantial amounts of water in use and/or which can be recycled. Suitable polymers include polyolefins, particularly high density polyethylene and polypropylene. If it is desirable to recycle the drain inlet cover, the filter is preferably composed of a polymer which can be recycled in the same batch as the other members, and which is preferably the same as the polymer in the other members.

Drain Inlet Covers

The optimum dimensions of the drain inlet cover will depend on the dimensions of the drain which is to be covered. Exemplary dimensions, in inches, are shown in the table below. A plurality of covers can be assembled side-by-side to create an extended cover of greater length.

| | 1 | 2 | 3 |
|---|---|---|---|
| Drain type | No grate in road | Grate in road | Grate in road |
| Length of horizontal and vertical sections, measured along the line of the curb | 24–36 | 24–30 | 44–88 |
| Width of horizontal section, measured at right angles to the curb | 6–10 | 24–30 | 24–30 |
| Height of vertical section | 6–8 | 6–8 | 6–8 |
| Height of vertical filter | 3–5 | 3–5 | 3–5 |

The drain inlet cover can include other components in addition to the upper, lower, front and rear members, and the horizontal and vertical filter members. For example, the drain inlet cover can include one or more of the following additional components.

(a) One or more support members, for example along the junction between the horizontal and vertical sections, and/or along the top of the vertical section, and/or at the vertical edges and/or at intermediate points of the vertical section, and/or along the front and/or side edges of the horizontal section.

(b) One or more sealing members placed underneath the lower member of the horizontal section, e.g. underneath some or all of the front and side marginal portions of the lower member, in order to help to seal the drain inlet cover to the road surface so that water flows over, not under, the cover. The sealing member(s) can for example be composed of a non-woven fabric, e.g. a geotextile fabric, filter material as described above.

(c) One or more sealing members placed behind the rear member of the vertical section, e.g. on some or all of the front and side marginal portions of the rear member, in order to help to seal the drain inlet cover to the curb. The sealing member(s) can for example be as described in paragraph (b) above.

(d) One or more weights, for example around the periphery of the horizontal section, to help to seal the drain inlet to the road surface so that water flows over, not under, the cover, and to maintain the drain inlet cover in a desired location.

(e) One or more spacers placed between the horizontal filter member and one or both of the upper and lower members, and/or between the vertical filter member and one or both of the front and rear members.

The vertical section, when viewed in plan, can be straight or can be curved to fit around a curved curb.

Preferably the drain inlet cover is constructed so that it is not adversely affected by traffic and so that a lighted cigarette dropped onto the cover burns itself out without substantially damaging the cover.

Preparation of Drain Inlet Covers

The novel drain inlet covers can be prepared by the method of the third aspect of the invention, or in any other convenient way. For example, the vertical and horizontal sections can be prepared separately, and joined together, substantially at right angles to each other in any convenient way. The various components of the drain inlet cover can for example be secured to each other by melt bonding of polymeric components (e.g. spot welding of the filter materials) and/or with the aid of adhesives, for example hot melt adhesives and/or thermal setting adhesives.

In the method of the third aspect of the invention, the configuration of the precursor can be stabilized in any convenient way, for example by the application of heat, for example a heated metal bar, to a fold in the precursor.

Precursors

The precursors preferably used in the method of the third aspect of the invention comprise first and second laminar members and a laminar filter member. These members are sized and arranged so that the precursor can be fixed in a configuration which results in the desired drain inlet cover. The precursor can include a marker, which may also be a line of weakness, corresponding to a line along which it is to be folded. In some embodiments, the first and second members are of the same size and have coincident edges. In some embodiments, the filter member has the same size as at least one of the first and second members and has coincident edges with that member; in other embodiments, the filter member is smaller in one or both dimensions than at least one of the first and second members, so that the precursor includes at least one marginal portion which is free of the filter member.

Drawings

Figure 2:
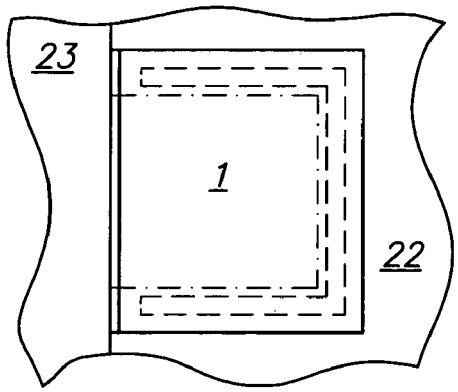
FIG. 2 is a plan view, of a roadside drain fitted with a drain inlet cover of the invention.
Figure 3:
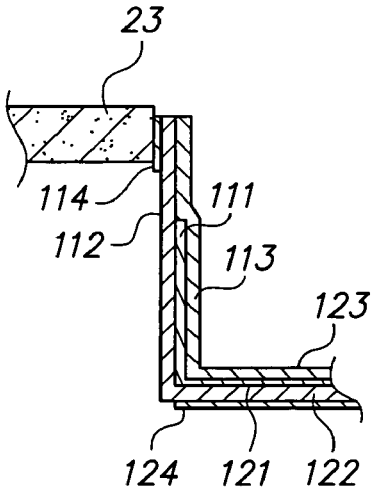
FIG. 3 is an enlarged view of part of FIG. 1.

Referring now to the drawings, FIGS. 1–3 show a drain inlet cover of the invention 1 being used to control the entry into a drain 21 of sediment suspended in sediment-bearing water flowing into the drain. The drain 21 is set in a road 22 which is bordered by sidewalk 23 having a curb 24. The drain is covered by grate 24 (whose periphery is shown by the dotted and broken line in FIG. 2), except for a rear portion underneath the sidewalk, to which there is access through an opening in the curb. Vertical section 11 of drain inlet cover 1 covers the opening in the curb and contacts adjacent portions of the curb via marginal sealing members 114. Horizontal section 12 of drain inlet cover 1 covers the grate 25 and extends over adjacent portions of the road, contacting them via a sealing member 124. The vertical section 11 comprises filter member 111 sandwiched between first and second polymeric netting members 112 and 113, and marginal sealing members 114. Filter member 111 stops short of the full height of the opening in the curb, so that excess sediment-bearing liquid can pass into the drain through the members 112 and 113 without passing through the filter member 111. The horizontal section 12 comprises filter member 121 sandwiched between first and second polymeric netting members 122 and 123, sealing member 124, and marginal weights 125 indicated by the broken lines in FIG. 2.

Figure 4:
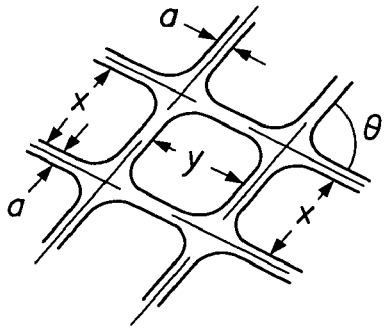
FIG. 4 is a plan view of a part of an apertured sheet material suitable for use as the members having a multiplicity of relatively large apertures therethrough.

FIG. 4 is a plan view of an example of the polymeric netting which can be used for the members having relatively large apertures therein. The thickness of the polymeric strands is designated a; the acute angle of the parallelogrammatic apertures is designated Θ; the major dimension parallel to the polymeric strands is designated x; and the minor dimension parallel to the polymeric strands is designated y.

Figure 5:
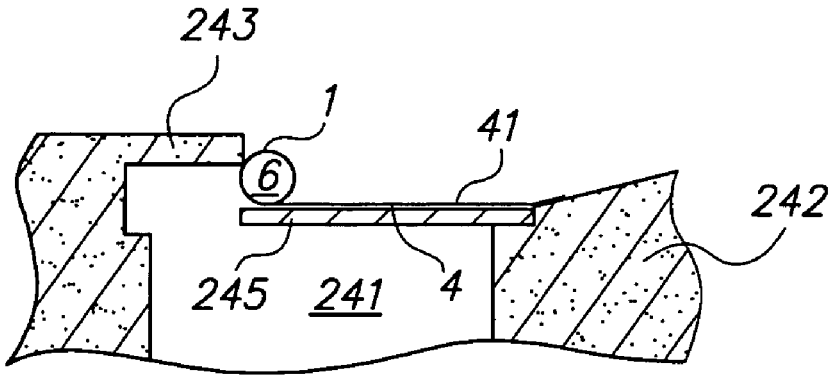
FIG. 5 is a cross-section and FIG. 6 is a plan view of another drain inlet cover of the invention.
Figure 6:
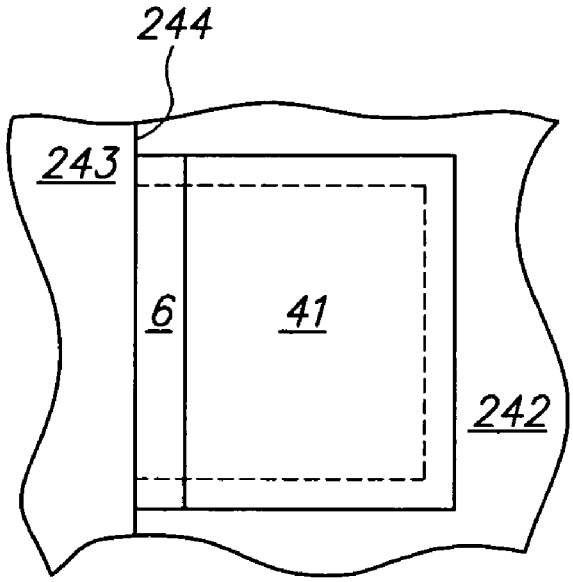

In FIGS. 5 and 6, a drain inlet cover in which the vertical section includes a hollow sediment collection chamber 6 is used to control the flow of sediment-bearing water into a drain 241 set into a road 242 which is bordered by sidewalk 243 having a curb 244. The drain is covered by grate 245 (whose periphery is shown by the broken line in FIG. 25), except for a rear portion underneath the sidewalk, to which there is access through an opening in the curb. The sediment collection chamber 6 covers the opening in the curb and contacts adjacent portions of the curb. The horizontal section 4 covers the grate 245 and extends over adjacent portions of the road.

I claim:

1. A drain inlet cover suitable for installation over a drain in a road which is bordered by a sidewalk and separated from the sidewalk by a vertical curb, with access to the drain through an opening in the curb, the drain inlet cover comprising 1) a horizontal laminar section which has front, rear and side edges, and 2) a vertical laminar section which has a lower edge secured to the rear edge of the horizontal section;

the horizontal section comprising (a) an upper laminar member which has a plurality of relatively large apertures therethrough, (b) a lower laminar member which has a plurality of relatively large apertures therethrough, and (c) a horizontal laminar filter member which (i) is sandwiched between the upper and lower members, and (ii) has a plurality of relatively small filter apertures therethrough; and the vertical section comprising (a) a front member which has a plurality of relatively large apertures therethrough, (b) a rear member which has a plurality of relatively large apertures therethrough, and (c) a vertical filter member which (i) lies between the front and rear members, and (ii) has a plurality of relatively small filter apertures therethrough.

2. A drain inlet cover according to claim 1 wherein the front and rear members are laminar members and the vertical filter member is sandwiched between them and in contact with each of them.

3. A drain inlet cover according to claim 1 wherein the front and rear members have a hollow chamber between them.

4. A drain inlet cover according to claim 1 wherein the median area of the apertures in each of the upper, lower, front and rear members is 0.03 to 0.16 $in^2$.

5. A drain inlet cover according to claim 1 wherein the minimum dimension of each of the apertures in each of the upper, lower, front and rear members is in the range 0.15 to 0.4 inch.

6. A drain inlet cover according to claim 1 wherein each of the horizontal filter member and the vertical filter member has a mesh size of 200 to 600 micron.

7. A drain inlet cover according to claim 1 wherein each of the horizontal filter member and the vertical filter member is composed of material is capable of passing 100 to 200 gallons of water per square foot per minute.

8. A drain inlet cover according to claim 1 which includes a sealing member underneath the horizontal section, or a sealing member behind the vertical section, or both.

9. A drain inlet cover according to claim 1 which includes weights around the periphery of the horizontal section.

10. A drain inlet cover suitable for installation over a drain in a road which is bordered by a sidewalk and separated from the sidewalk by a vertical curb, with access to the drain through an opening in the curb, the drain inlet cover comprising 1) a horizontal laminar section which has front, rear and side edges, and 2) a vertical laminar section which has a lower edge secured to the rear edge of the horizontal section;

the horizontal section comprising (a) an upper laminar member which is composed of a polymeric composition and which has a plurality of apertures therethrough, the apertures having a minimum dimension in the range 0.15 to 0.5 inch, (b) a lower laminar member which is composed of a polymeric composition and which has a plurality of apertures therethrough, the apertures having a minimum dimension in the range 0.15 to 0.5 inch, and (c) a horizontal laminar filter member which (i) is sandwiched between the upper and lower members, and (ii) has a plurality of filter apertures therethrough, the filter apertures being substantially smaller than the apertures in the upper and lower laminar members; and the vertical section comprising (a) a front member which is composed of a polymeric composition and which has a plurality of apertures therethrough, the apertures having a minimum dimension in the range 0.15 to 0.5 inch, (b) a rear member which is composed of a polymeric composition and which has a plurality of apertures therethrough, the apertures having a minimum dimension in the range 0.15 to 0.5 inch, and (c) a vertical filter member which (i) lies between the front and rear members, (ii) has a plurality of relatively small filter apertures therethrough, the filter apertures being substantially smaller than the apertures in the front and rear members, and (iii) extends from the bottom of vertical section to a level which is 60 to 80% of the height of vertical section.

11. A drain inlet cover according to claim 10 wherein the front and rear members are laminar members and the vertical filter member is sandwiched between them and in contact with each of them.

12. A drain inlet cover according to claim 11 wherein the upper laminar member and the front laminar member are different parts of a first monolithic apertured polymeric sheet, and the lower laminar member and the rear laminar member are different parts of a second monolithic apertured polymeric sheet.

13. A drain inlet cover according to claim 10 wherein the front and rear members are laminar members having a hollow chamber between them.

14. A drain inlet cover according to claim 13 wherein the front, rear, upper and lower members are different parts of a monolithic apertured polymeric sheet.

15. A drain inlet cover according to claim 10 wherein the horizontal filter member has a mesh size of 200 to 500 micron and the vertical filter member has a mesh size of 200 to 500 micron.

16. A drain inlet cover according to claim 10 which includes a sealing member underneath the horizontal section, or a sealing member behind the vertical section, or both.

17. A method of reducing the amount of sediment which passes through a drain in a road which is bordered by a sidewalk and separated from the sidewalk by a vertical curb, the curb having an opening which provides access to the drain, and the drain having a rear portion which is unobstructed at the road level but is covered by the sidewalk, the method comprising placing a drain inlet cover as defined in claim 1 over the drain, the horizontal section of the drain inlet cover being placed on the road and the vertical section being placed so that covers at least a lower portion of the opening in the curb and overlaps side edges of the opening in the curb.

18. A method according to claim 17 wherein (i) the drain includes a grate which is set in the road and which has front, rear and side edges, the rear edge being adjacent to the opening in the curb, and (II) the front and side edges of the horizontal portion of the drain inlet cover overlap the front and side edges of the grate, and the horizontal filter member extends over substantially all of the grate.

19. A method of making a drain inlet cover, the method comprising (A) providing a precursor comprising (a) a first laminar member which is composed of a polymeric material and has a plurality of relatively large apertures therethrough, (b) a second laminar member which is composed of a polymeric material and has a plurality of relatively large apertures therethrough, and (c) a laminar filter member which (i) is composed of the polymeric material, (ii) is sandwiched between the first and second members, and (iii) has a plurality of relatively small filter apertures therethrough;

(B) configuring the precursor into a configuration to provide horizontal and vertical sections; and (C) stabilizing the precursor in the configuration.

20. A precursor for a drain inlet cover, the precursor comprising (a) a first laminar substantially rectangular member which is composed of a polymeric material and has a plurality of relatively large apertures therethrough, (b) a second laminar substantially rectangular member which is composed of a polymeric material and has a plurality of relatively large apertures therethrough, and which overlaps 80 to 100% of the first layer; and (c) a laminar substantially rectangular filter member which (i) is composed of a polymeric material, (ii) is sandwiched between, and does not extend beyond the first and second members, and which overlaps 80 to 100% of the area of the second member, and (iii) has a plurality of relatively small filter apertures therethrough;

a part of the first member, or a part of the second member, or parts of both the first member and second member, extending beyond the filter member to provide a rectangular section which is free of the filter member.

* * * * *